US007275399B2

(12) United States Patent
Park et al.

(10) Patent No.: US 7,275,399 B2
(45) Date of Patent: Oct. 2, 2007

(54) CONDENSING APPARATUS FOR WASHING AND DRYING MACHINE

(75) Inventors: Young-Hwan Park, Gyeonggi-Do (KR); Kyung-Seop Hong, Incheon (KR); Choon-Myun Chung, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 570 days.

(21) Appl. No.: 10/687,639

(22) Filed: Oct. 20, 2003

(65) Prior Publication Data

US 2005/0081575 A1 Apr. 21, 2005

(51) Int. Cl.

| | |
|---|---|
| ***D06F 25/00*** | (2006.01) |
| ***D06F 35/00*** | (2006.01) |
| ***D06F 39/04*** | (2006.01) |
| ***D06F 58/24*** | (2006.01) |

(52) U.S. Cl. ..... 68/18 C; 68/20; 34/77

(58) Field of Classification Search ..... 68/18 R, 68/18 C, 19.2, 20; 34/76–77

See application file for complete search history.

(56) References Cited

U.S. PATENT DOCUMENTS

| | | | | |
|---|---|---|---|---|
| 2,453,859 A | | 11/1948 | Pugh | |
| 2,843,943 A | | 7/1958 | Geldhof et al. | |
| 3,012,333 A | | 12/1961 | Leonard | |
| 4,154,003 A | * | 5/1979 | Muller | 34/469 |
| 5,146,693 A | | 9/1992 | Dottor et al. | |
| 5,588,313 A | * | 12/1996 | Hildebrand | 68/17 R |
| 2002/0178765 A1 | * | 12/2002 | Matsuda et al. | 68/20 |
| 2004/0103697 A1 | * | 6/2004 | Kim et al. | 68/18 R |

FOREIGN PATENT DOCUMENTS

| | | |
|---|---|---|
| GB | 2223240 | 4/1992 |
| JP | 2003-062384 | 3/2003 |
| JP | 2003-154186 | 5/2003 |
| WO | 0357968 | 7/2003 |

OTHER PUBLICATIONS

English Language Abstract of JP 2003-154186.
English Language Abstract of JP 2003-062384.

* cited by examiner

*Primary Examiner*—Joseph L. Perrin
(74) *Attorney, Agent, or Firm*—Greenblum & Bernstein, P.L.C.

(57) ABSTRACT

A condensing apparatus of a washing and drying machine includes a casing that forms an accommodating space therein; a tub installed in the casing; an air duct of which one end is connected to the tub to thus introduce air into the tub; a blower fan that blows air along the air duct; and a heater that heats air of the air duct before being introduced into the tub. The condensing apparatus includes: a condensing duct of which one end is connected to a lower region of the tub and another end extends upwardly; a condensate water supplying duct connected to an upper region of the condensing duct to supply condensate water into the condensing duct; and a condensate water dispersing portion provided with a plurality of dispersion holes formed along a circumferential direction of the condensing duct with a certain interval and arranged at an outlet side of the condensate water supplying duct along a flow direction of the condensate water, to dispersedly drop condensate water supplied from the condensing water supplying duct.

14 Claims, 8 Drawing Sheets

CONDENSING APPARATUS FOR WASHING AND DRYING MACHINE

BACKGROUND OF THE INVENTION

1. Field of the Invention

The present invention relates to a condensing apparatus for a washing and drying machine, and more particularly, to a condensing apparatus for a washing and drying machine capable of increasing drying performance by improving condensing efficiency.

2. Description of the Conventional Art

FIG. 1 is a sectional view of a washing and drying machine in accordance with the conventional art, and FIG. 2 is an enlarged view of a condensing duct of FIG. 1. As shown, the washing and drying machine comprises a casing 11 forming an accommodation space therein, a tub 21 arranged in the casing 11 for receiving water for washing laundry therein, a rotary drum 31 rotatably arranged around a rotary axis arranged along a horizontal direction in the tub 21, and a drum driving motor 33 for driving the rotary drum 31.

The casing 11 has a quadrangular box shape and is provided with an inlet for introducing laundry at the front surface thereof. At one side of the inlet, a door 13 for opening and closing the inlet is formed.

The tub 21 has a box shape of which one side is opened, and the opened region is arranged correspondingly the inlet. A spring member 23 and a damper 25 for elastically supporting the tub 21 are respectively installed at the upper and lower sides of the tub 21. Also, a drain duct 27 and a drain pump 29 for draining washing water are installed at one side of the lower portion of the tub 21.

At a rear region of the tub 21, a condensing duct 41 is installed in a state that one end thereof is connected to the tub 21 and another end thereof is upwardly extending. A blower fan 47 for sucking air inside of the tub 21 through the condensing duct 41 is installed at the upper end of the condensing duct 41. Another end of an air duct 48 of which one end is connected to the upper front surface of the tub 21 is connected to an outlet of the blower fan 47. A heater 49 for heating air is installed in the air duct 48.

The condensing duct 41 has an 'L' shape in which air and condensate water sucked from the tub 21 can flow, and a fan coupling portion 42 to which the blower fan 47 is coupled is formed at the upper region thereof. Into one side of the fan coupling portion 42, one end of a condensate water supplying duct 43 for supplying condensate water is introduced. Also, at a periphery of the condensate water supplying duct 43 introduced into the fan coupling portion 42, a condensate water accommodating portion 44 for accommodating supplied condensate water with a predetermined amount is formed. To the lower end of the condensing duct 41, another end of a connection bellows 45 of which one end is connected to the tub 21 is connected.

Under this construction, when a dewatering process is finished and a drying process is started thus to drive the blower fan 47, air is sucked from the inside of the tub 21 and flows upwardly along the condensing duct 41. The air which has upwardly flowed flows along the air duct 48 and is heated by the heater 49 thus to be introduced into the tub 21.

High temperature air which has been introduced into the tub 21 contains moisture of laundry, flows along the condensing duct 41, and is condensed by being cooled by condensate water supplied through the condensate water supplying duct 43. Low temperature air of which moisture is removed is heated by the heater 49, and the heated high temperature and dry air is introduced into the tub 21, contains moisture of laundry, and is condensed in the condensing duct 41, thereby performing a drying process of the laundry.

However, in the conventional washing and drying machine, the condensing duct 41 has a comparatively complicated structure thus to have a difficult fabrication process and air flow is not smooth thus to degrade drying performance. Also, condensate water supplied from the condensate water supplying duct 43 downwardly flows through one side region of the condensing duct 41 as shown in FIG. 2, and air sucked from the tub 21 upwardly flows through another side region, thereby not having an excellent condensing efficiency and thus degrading drying performance.

SUMMARY OF THE INVENTION

Therefore, an object of the present invention is to provide a condensing apparatus of a washing and drying machine capable of improving drying performance by enhancing condensing efficiency.

To achieve these and other advantages and in accordance with the purpose of the present invention, as embodied and broadly described herein, there is provided a condensing apparatus of a washing and drying machine comprising a casing for forming an accommodating space therein; a tub installed in the casing; an air duct of which one end is connected to the tub thus for introducing air into the tub; a blower fan for blowing air along the air duct; and a heating means for heating air of the air duct before being introduced into the tub, the condensing apparatus comprising: a condensing duct of which one end is connected to a lower region of the tub and another end is upwardly extending; a condensate water supplying duct connected to an upper region of the condensing duct for supplying condensate water into the condensing duct; and a condensate water dispersing portion provided with a plurality of dispersion holes formed along a circumferential direction of the condensing duct with a certain interval and arranged at an outlet side of the condensate water supplying duct along a flow direction of the condensate water, for dispersing condensate water supplied from the condensing water supplying duct and dropping.

The condensing water dispersing portion is preferably a condensate water dispersion member composed of an inner rib of a ring shape for forming an air hole through which air passes at a center thereof; an outer rib arranged concentrically with the inner rib and having a larger diameter than a diameter of the inner rib; a connection bottom portion provided with a plurality of dispersion holes penetratingly formed in order to disperse and drop flowing condensate water, for connecting bottoms of the inner rib and the outer rib in order to form a condensate water channel through which the condensate water flows between the outer rib and the inner rib.

The condensing water dispersing member is composed of at least one inner dispersion portion having an air passing interval between the inner rib and connected to the condensate water channel thus for dispersedly dropping condensate water at a center region thereof, and a plurality of connection channel portion for connecting the condensate water channel and the inner dispersion portion.

At least one penetration hole for dropping condensate water is preferably formed at a bottom of the connection channel portion.

The condensate water supplying duct is connected to the condensate water dispersing member along a tangential direction of the outer rib, and the connection channel portion is formed to approach to the inner dispersion portion along a circumferential direction of the inner rib.

The condensing duct is preferably constructed to have a circular section shape and to be downwardly extending from a connection region of the condensate water supplying duct with a predetermined length along an inner circumference thereof.

The condensing duct further comprises a connection bellows of which one end is connected to a lower end of the condensing duct and another end is connected to a lower region of the tub.

It is preferable that a connection drain duct connected to a drain duct of the tub for draining the condensate water is formed at the connection bellows.

It is preferable to further comprise a chamber having more expanded flow section area than the condensing duct, having one side connected to the condensing duct and another side connected to an inlet of the blower fan, and provided with a condensate water supplying opening to which the condensate water supplying duct is coupled at one side thereof.

The condensate water dispersion portion is preferably a condensate water guide formed as a ring shape having a predetermined diameter in order to pass air at a center thereof and provided with a cylindrical portion for guiding condensate water to flow along a circumferential surface of the condensing duct between the chamber accordingly as a bottom of the cylindrical portion is in contact with inside of the chamber.

A guiding inclination portion slantingly extending outwardly along a radius direction from an upper end of the cylindrical portion and extending along a circumferential direction for guiding condensate water supplied from the condensate water supplying duct to overflow to a center region where the air passes is formed at an upper portion of the condensate water guide.

Preferably, the condensing duct is provided with a plurality of protrusion portions protruding towards a center thereof from an inner wall thereof.

Preferably, the protrusion portions are ribs reciprocally extending along a circumferential direction thereof.

Preferably, the protrusion portions are spirally formed along an inner circumference of the condensing duct.

Preferably, the protrusion portions are inclined toward an upper side of the condensing duct.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
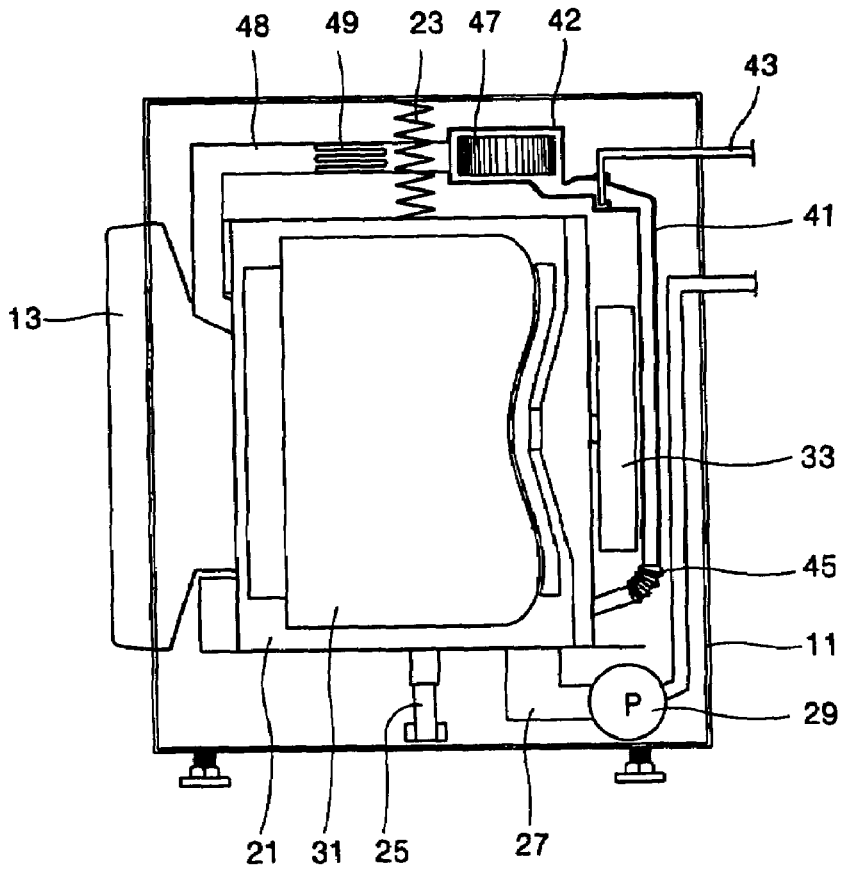
FIG. 1 CONVENTIONAL ART
FIG. 1 is a sectional view of a washing and drying machine in accordance with the conventional art.
Figure 2:
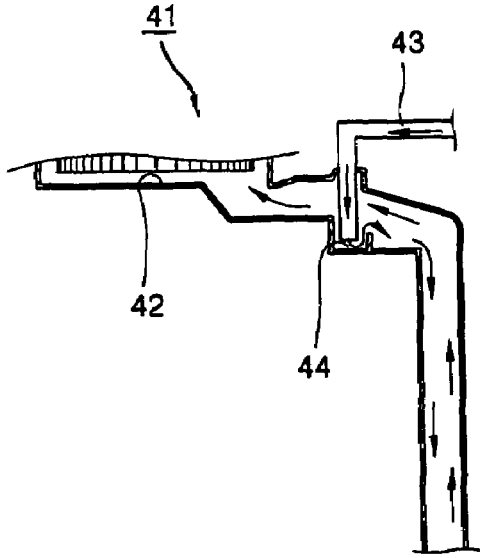
FIG. 2 CONVENTIONAL ART
FIG. 2 is an enlarged view of a region of a condensing apparatus of FIG. 1.
Figure 3:
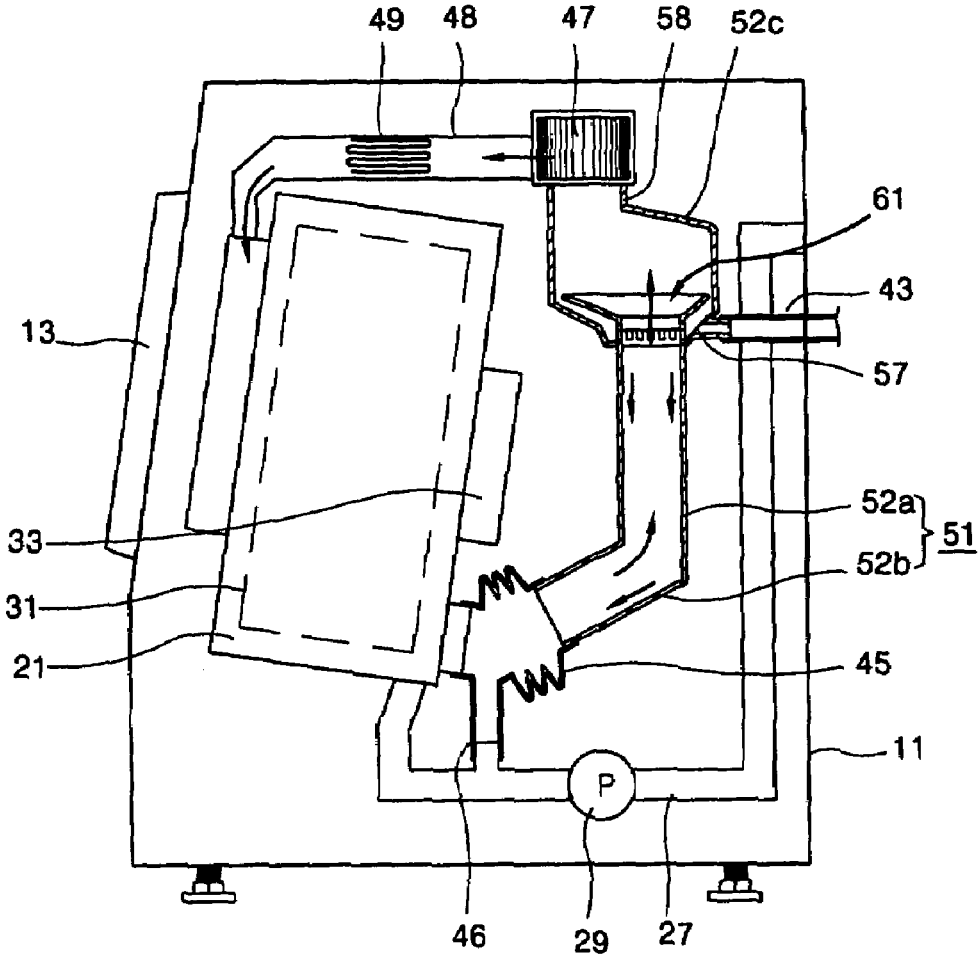
FIG. 3 is a view showing a use state of a condensing apparatus of a washing and drying machine according to a first embodiment of the present invention.
Figure 4:
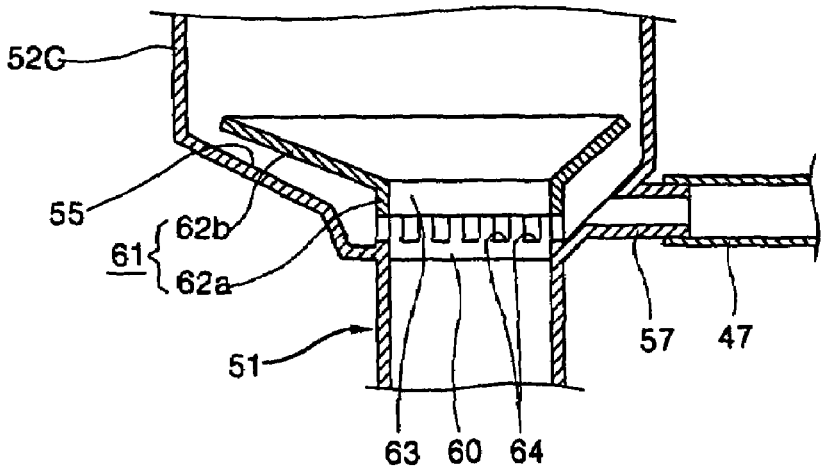
FIG. 4 is an enlarged view of main parts of FIG. 3.
Figure 5:
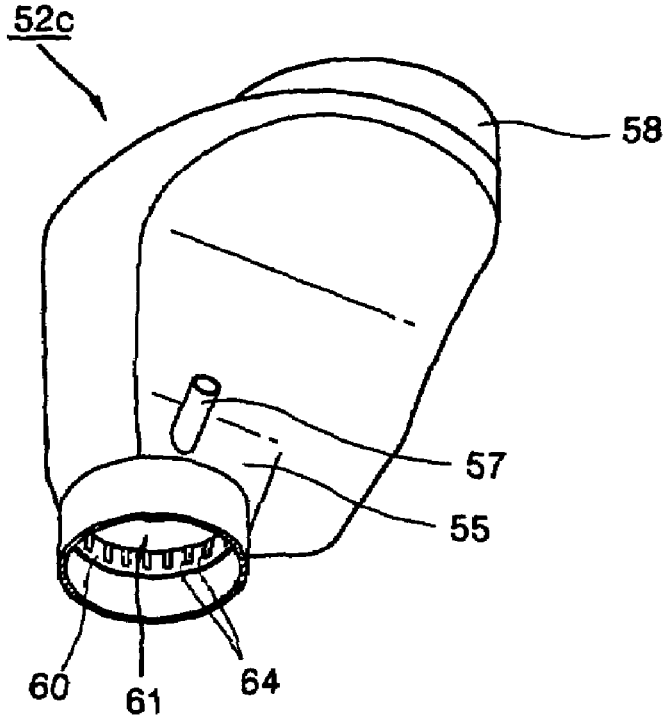
FIG. 5 is a perspective view of a chamber of FIG. 3.
Figure 6:
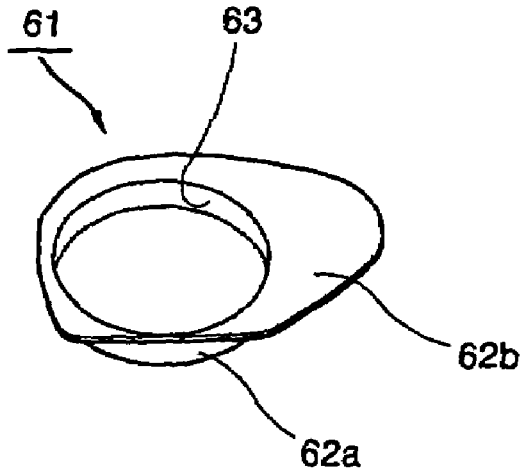
FIG. 6 is a perspective view of a condensate water guide of FIG. 3.

FIG. 3 is a view showing a use state of a condensing apparatus of a washing and drying machine according to a first embodiment of the present invention, FIG. 4 is an enlarged view of main parts of FIG. 3, FIG. 5 is a perspective view of a chamber of FIG. 3, and FIG. 6 is a perspective view of a condensate water guide of FIG. 3. The same reference numerals will be given to parts having the same construction as the aforementioned parts.

As shown, the washing and drying machine comprises a casing 11 forming an accommodation space therein, a tub 21 arranged in the casing 11 for accommodating water for washing laundry therein, a rotary drum 31 rotatably arranged in the tub 21, and a drum driving motor 33 for driving the rotary drum 31.

The tub 21 has a box shape of which one side is opened, and the opened region is upwardly slanted in the casing 11. The tub 21 is provided with a condensing apparatus of the washing and drying machine according to the first embodiment of the present invention at a rear region thereof.

The condensing apparatus of the washing and drying machine comprises a condensing duct 51 of which one side is connected to the tub 21, an air duct 48 of which one end is connected to a front upper portion of the tub 21 and another end is connected to the condensing duct 51, a blower fan 47 arranged between the condensing duct 51 and the air duct 48 for introducing air inside of the tub 21 and returning to the tub 21 via the condensing duct 51 and the air duct 48, a condensate water supplying duct 43 for supplying condensate water to the condensing duct 51, and a condensate water guide 61 for dispersedly supplying condensate water supplied from the condensate water supplying duct 43 to the inside of the condensing duct 51.

The condensing duct 51 is composed of a vertical section portion 52*a* having a sectional surface of a circular shape and arranged up and down in the casing 11, and a slanted section portion 52*b* slantingly arranged with a bending from a lower end of the vertical section portion 52*a* towards the tub 21.

To the slanted section portion 52*b*, another end of a connection bellows 45 of which one end is connected to a lower rear region of the tub 21 is connected. At a lower region of the connection bellows 45, a connection drain duct 46 of which one end is connected to a drain duct 27 of the tub 21 is formed to discharge condensate water.

A chamber 52*c* having more expanded flow section area than the condensing duct 51 is formed at an upper end portion of the condensing duct 51, and a condensate water guide 61 is installed in the chamber 52*c*.

An inclination portion 55 upwardly slanted to have more increased flow sectional area than the condensing duct 51 is formed at a lower portion of the chamber 52*c*, and a fan coupling portion 58 connected to an inlet of the blower fan 47 is formed at an upper portion of the chamber 52*c*. At one side of the inclination portion 55, a water supplying opening 57 is formed so that the condensate water supplying duct 43 can be coupled thereto. A condensate water dispersion portion 60 of a ring shape for accommodating condensate water supplied from the condensate water supplying duct 43 with a certain amount and dispersedly dropping is formed at a lower inner region of the inclination portion 55. Also, at the condensate water dispersing portion 60, a plurality of condensate water dispersion grooves 64 for dropping condensate water are dented with a certain gap along a circumferential direction thereof.

The condensate water guide 61 is composed of a cylindrical portion 62*a* having a cylindrical shape and provided with an air opening 63 for passing air which upwardly flows from the condensing duct 51, and a guiding inclination portion 62*b* upwardly-slantingly extending from an upper end of the cylindrical portion 62*a*. The cylindrical portion 62*a* is formed to have approximately the same diameter as an inner diameter of the condensing duct 51, and a lower region thereof is arranged to be in contact with an upper end of the condensate water dispersing portion 60.

Under this construction, when a dehydration process is finished and a drying process is started thus to drive the blower fan 47, air inside of the tub 21 is sucked through the connection bellows 45 and flows upwardly along the condensing duct 51. The air which has upwardly flowed passes through the blower fan 47 thus to be heated by the heater 49. The heated air of high temperature is introduced into the tub 2, contains moisture of laundry thus to be sucked through the connection bellows 45, and upwardly flows along the condensing duct 51.

In the meantime, condensate water supplied to inside of the chamber 52*c* from the condensate water supplying duct 43 flows along a circumferential direction of the condensate water guide 61. A certain amount of the condensate water is accommodated at a space between the condensate water guide 61 and the chamber 52*c* and a space between the condensate water guide 61 and the condensate water dispersing portion 60, and a part of the condensate water is uniformly dropped at an entire circumferential surface of the condensing duct 51 through the condensate water dispersion grooves 64 formed at the condensate water dispersing portion 60. According to this, high temperature and humid air sucked from the tub 21 is fast heat-exchanged thus to be condensed, and moisture in the air is dropped with the condensate water flows to the drain duct 27 through the connection duct 46 formed at a lower region of the connection bellows 45, thereby being sucked to outside by a driving of the drain pump 29.

Dry air which has upwardly flowed along the condensing duct 51 is heated by the heater 49 thus to be changed into high temperature and dry air, thereby being introduced into the tub 21. Then, the dry air contains moisture of the laundry thus to be sucked and said processes are repeated, thereby performing a drying process of the laundry.

Figure 7:
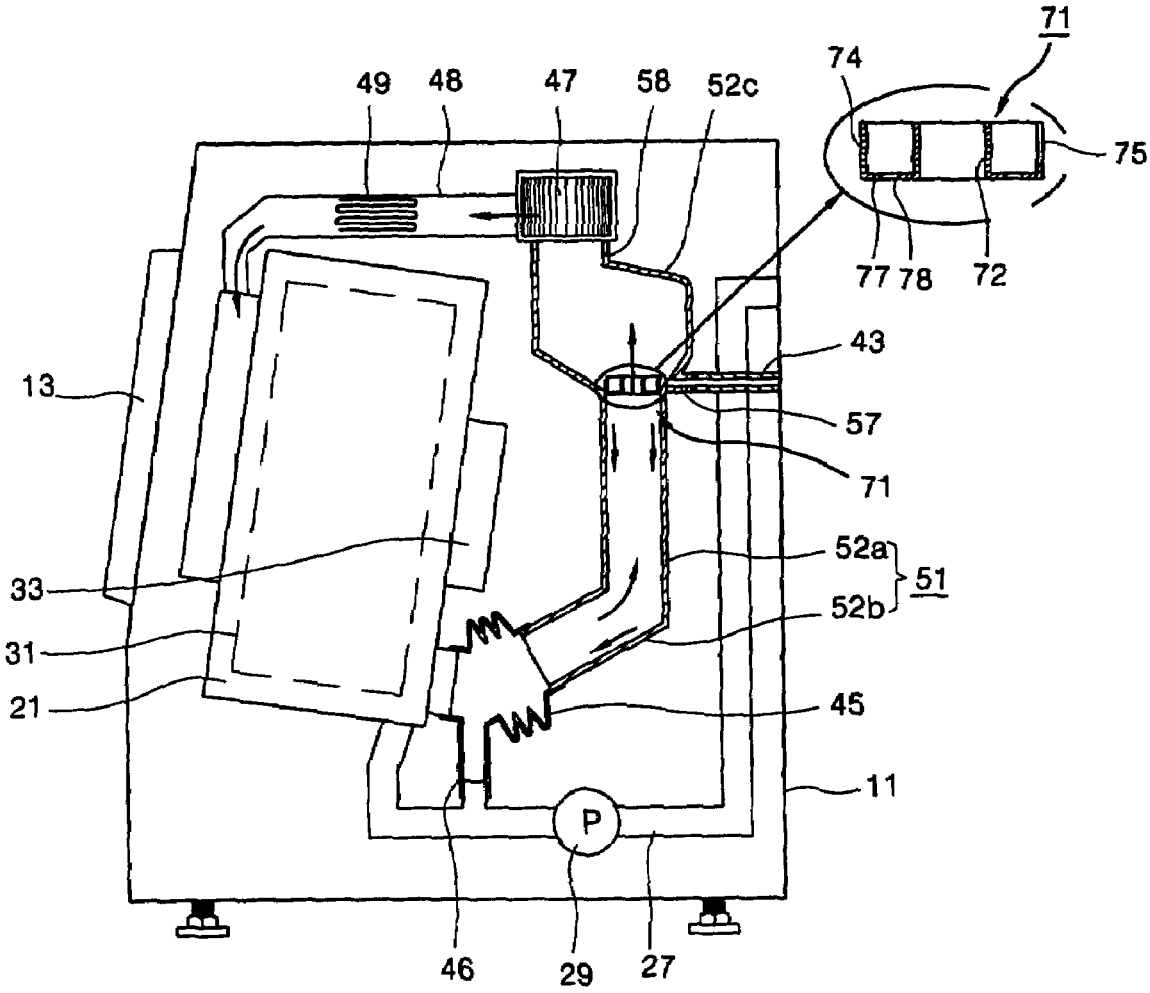
FIG. 7 is a view showing a use state of a condensing apparatus of a washing and drying machine according to a second embodiment of the present invention.
Figure 8:
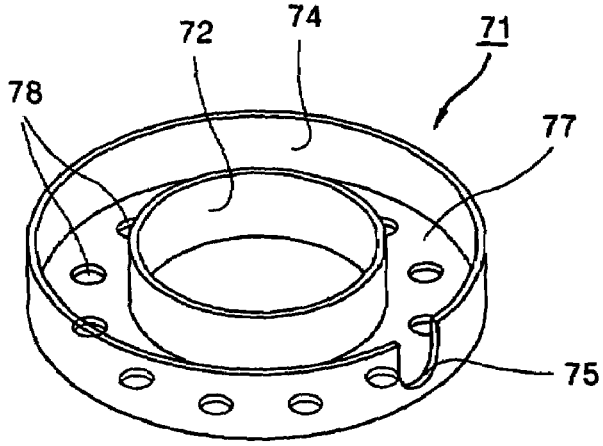
FIGS. 8 and 9 are respectively perspective and plane views of a condensate water dispersing member of FIG. 7.
Figure 9:
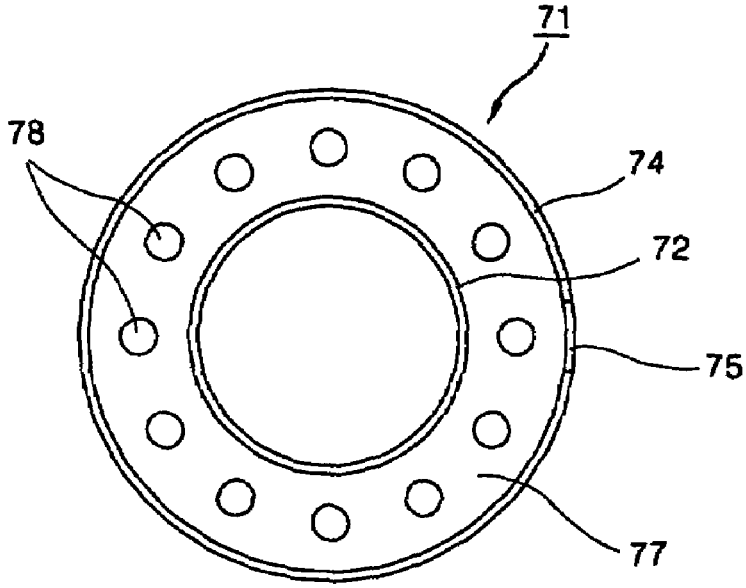

FIG. 7 is a view showing a use state of a condensing apparatus of a washing and drying machine according to a second embodiment of the present invention, and FIGS. 8 and 9 are respectively perspective and plane views of a condensate water dispersing member of FIG. 7. The same reference numerals will be given to parts having the same construction as the aforementioned parts and their detail explanation will be omitted. As shown, the condensing apparatus of the washing and drying machine comprises a condensing duct 51 of which one side is connected to the tub 21, an air duct 48 of which one end is connected to a front upper region of the tub 21 and another end is connected to the condensing duct 51, a blower fan 47 arranged between the condensing duct 51 and the air duct 48 for introducing air inside of the tub 21 and returning to the tub 21 via the condensing duct 51 and the air duct 48, a condensate water supplying duct 43 for supplying condensate water to the condensing duct 51, and a condensate water dispersing member 71 for dispersedly supplying condensate water supplied from the condensate water supplying duct 43 to the inside of the condensing duct 51.

The condensing water dispersing member 71 includes an inner rib 72 for forming an air passing hole through which air passes at a center thereof, an outer rib 74 arranged concentrically with the inner rib 72 and arranged at an outer side of the inner rib 72 with a distance in order to form a condensate water accommodating space between the inner rib 72, and a connection bottom portion 77 for connecting bottoms of the inner rib 72 and the outer rib 74.

At one side of the outer rib 74, an inlet 75 for introducing condensate water supplied from the condensate water supplying duct 43 is penetratingly formed. A plurality of penetration holes 78 for dropping condensate water and uniformly dispersing condensate water along a circumferential direction of the condensing duct 51 are penetratingly formed at the connection bottom portion 77 with a certain interval along a circumferential direction.

Under this construction, condensate water supplied from the condensate water supplying duct 43 is accommodated in the accommodating space formed by the inner rib 72, the outer rib 74, and the connection bottom portion 77 through the inlet 75, and is uniformly dispersed to the inside of the condensing duct 51 through the dispersion holes 78 of the connection bottom portion 77 thus to be dropped.

Figure 10:
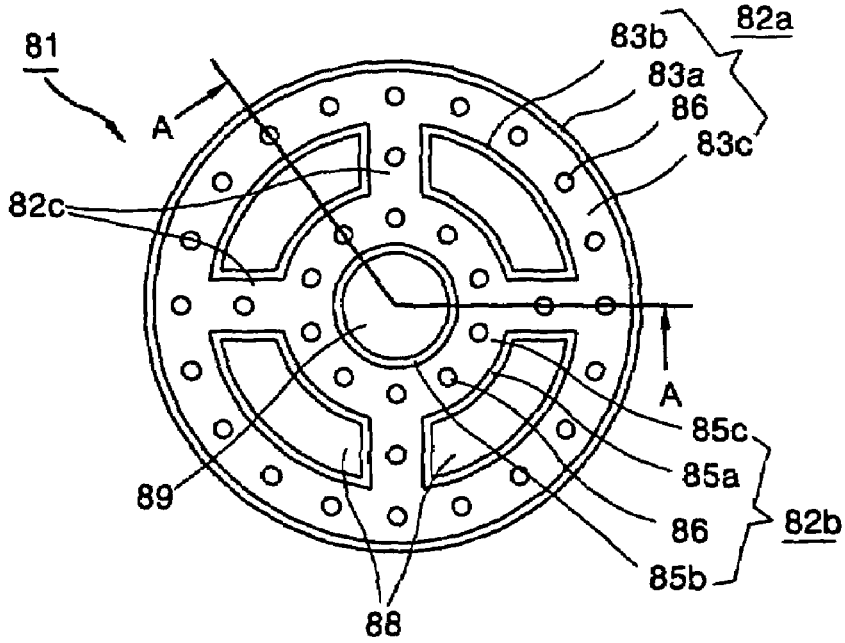
FIG. 10 is a plane view of a condensate water dispersing member of a washing and drying machine according to a third embodiment of the present invention.
Figure 11:
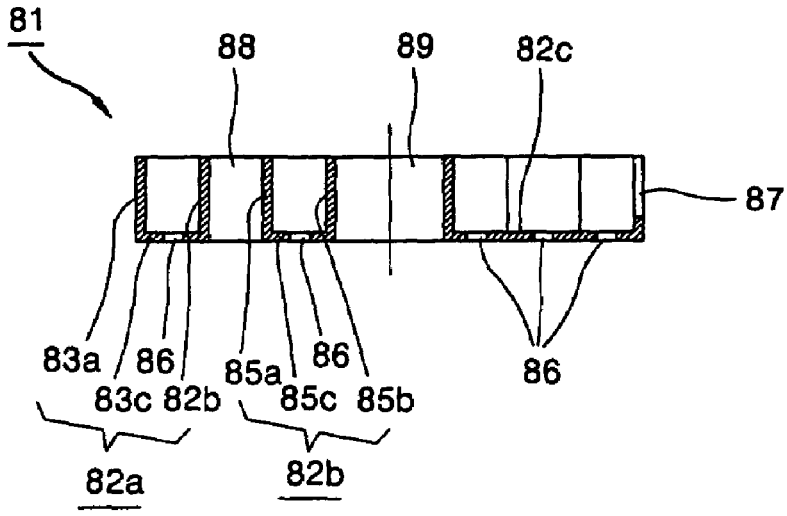
FIG. 11 is a sectional view taken along line A-A of FIG. 10.
Figure 12:
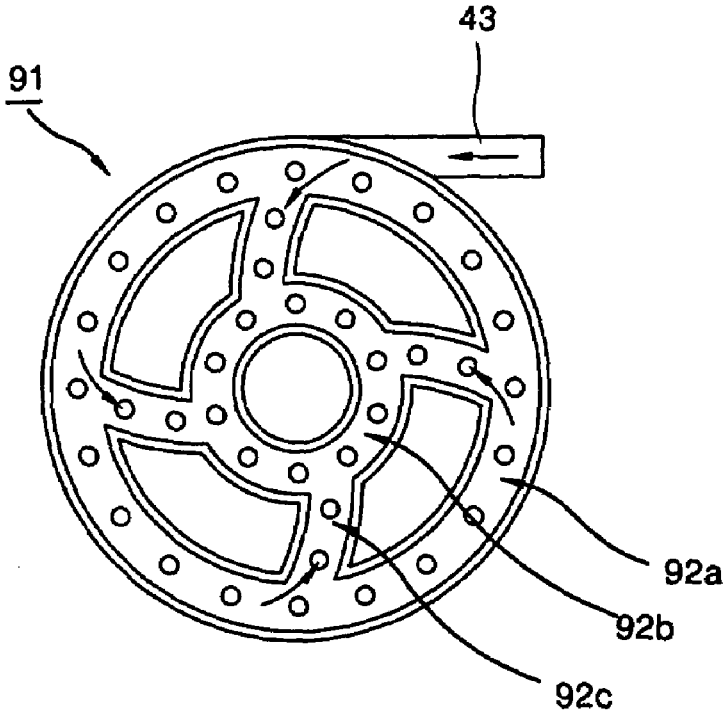
FIG. 12 is a plane view of a condensate water dispersing member of a washing and drying machine according to a third embodiment of the present invention.

FIG. 10 is a plane view of a condensate water dispersing member of a washing and drying machine according to a third embodiment of the present invention, FIG. 11 is a sectional view taken along line A-A of FIG. 10, and FIG. 12 is a plane view of a condensate water dispersing member of a washing and drying machine according to a third embodiment of the present invention. As shown, the condensing water dispersing member 81 is composed of an outer dispersion portion 82*a* and an inner dispersion portion 82*b* concentrically arranged in a state that an air passing hole 88 is positioned therebetween in order to pass air into the chamber 52*c* for uniformly dropping condensate water along a circumferential direction thereof, and a plurality of connection channel portion 82*c* for connecting the outer dispersion portion 82*a* and the inner dispersion portion 82*b*.

The outer dispersion portion 82*a* and the inner dispersion portion 82*b* are respectively provided with inner ribs 83*b* and 85*b*, outer ribs 83*a* and 85*a*, and connection bottom portions 83*c* and 85*c* connecting each bottom of the inner ribs and the outer ribs. A plurality of dispersion holes 86 are respectively penetratingly formed at the connection bottom portions 83*c* and 85*c* for dropping condensate water. An inlet 87 for introducing condensate water supplied from the condensate water supplying duct 43 is formed at the outer dispersion portion 82*a*, and an air passing hole 89 for passing air is formed at a center region of the inner dispersion portion 82*b*.

The connection channel portion 82*c* has a sectional surface of a 'U' shape so that condensate water can flow, and one end thereof is connected to the outer dispersion portion 82*a* and another end thereof is connected to the inner dispersion portion 82*b* so that condensate water introduced into the outer dispersion portion 82*a* can flow to the inner dispersion portion 82*b*. At a bottom of each connection channel portion 82*c*, a plurality of dispersion holes 86 for dropping condensate water are formed.

As shown in FIG. 12, the condensate water dispersion member 81 can be constructed as a shape of a condensate water dispersion member 91 composed of an outer dispersion portion 92*a* to which the condensate water supplying duct 43 is connected along a tangential direction and a plurality of connection channel portions 92*c* having a bent shape so that condensate water can be introduced into an inner dispersion portion 92*b* by being rotated towards an inner circumferential direction of the outer dispersion portion 92*a*.

Under this construction, condensate water supplied from the condensate water supplying duct 43 is introduced into the outer dispersion portion 82*a* through the inlet 87, and a part of the introduced condensate water is dispersed into the condensing duct 51 through the dispersion holes 86 formed at the connection bottom portion 83*c* thus to be dropped. A part of the introduced condensate water is introduced into each connection channel portion 82*c*, and some part thereof is dropped through the dispersion holes formed at lower portions of the connection channel portion 82*c* and the rest part is introduced into the inner dispersion portion 82*b* thus to be dropped.

Figure 13:
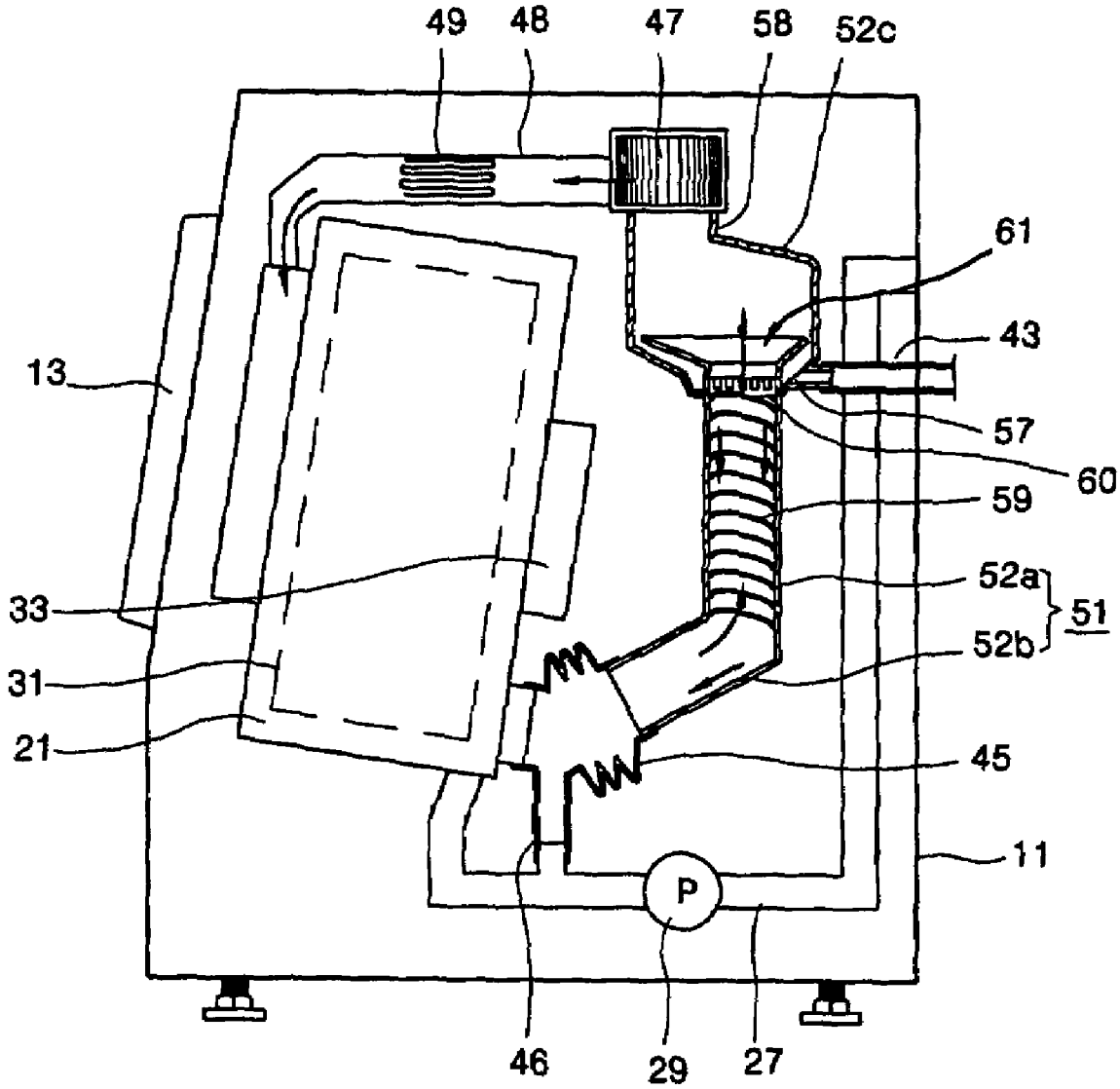
FIG. 13 is a view showing a use state of a condensing apparatus of a washing and drying machine according to a fourth embodiment of the present invention.
Figure 14:
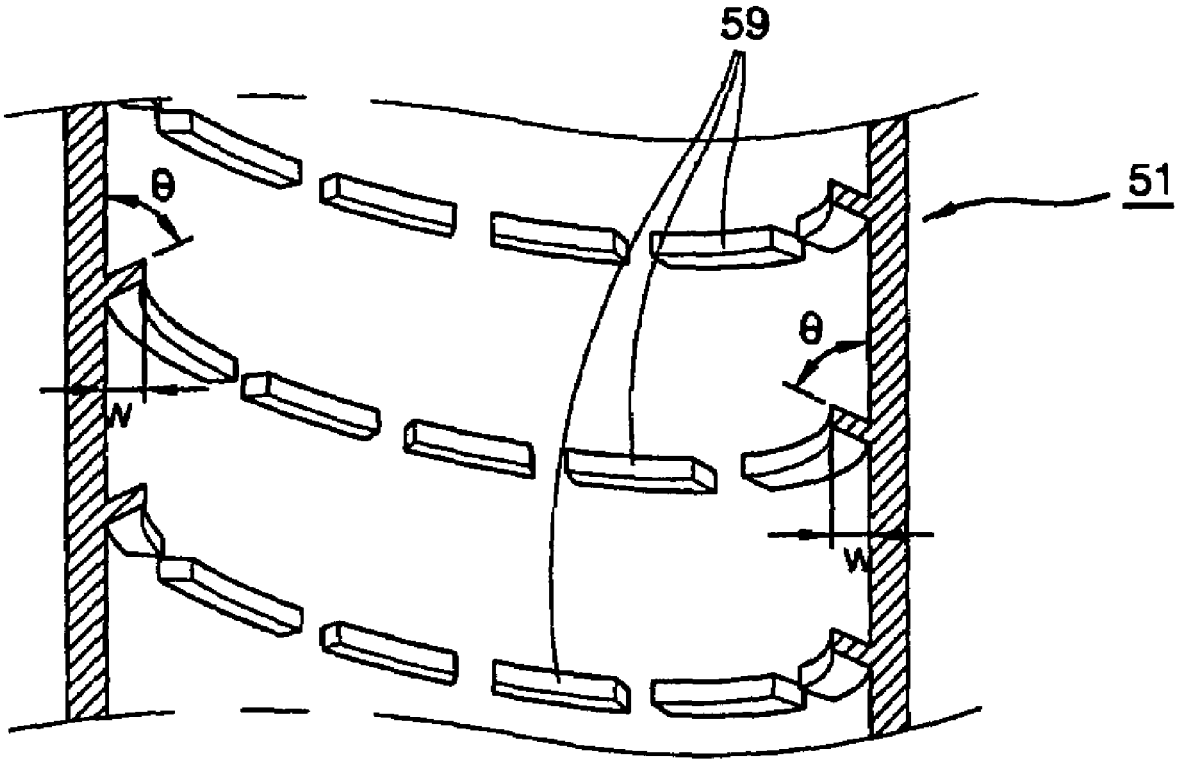
FIG. 14 is an enlarged view of a protruding region of FIG. 13.

FIG. 13 is a view showing a use state of a condensing apparatus of a washing and drying machine according to a fourth embodiment of the present invention, and FIG. 14 is an enlarged view of a protruding region of FIG. 13. As shown, the condensing apparatus of the washing and drying machine comprises a condensing duct 51 of which one side is connected to the tub 21, an air duct 48 of which one end is connected to a front upper region of the tub 21 and another end is connected to the condensing duct 51, a blower fan 47 arranged between the condensing duct 51 and the air duct 48 for introducing air inside of the tub 21 and returning to the tub 21 via the condensing duct 51 and the air duct 48, a condensate water supplying duct 43 for supplying condensate water to the condensing duct 51, a condensate water dispersing portion 60 and a condensate water guide 61 for dispersedly supplying condensate water supplied from the condensate water supplying duct 43 to the inside of the condensing duct 51, and a plurality of protrusion portions 59 protruding towards a center region in the condensing duct 51. The condensate water dispersion portion 60 and the condensate water guide 61 can be replaced by the condensate water dispersion members 71, 81, and 91.

The condensing duct 51 is composed of a vertical section portion 52*a* having a cylindrical shape and arranged along an inner circumferential surface, and a slanted section portion 52*b* slantingly extending from a lower end of the vertical section portion 52*a* towards the tub 21.

A chamber 52*c* is formed at an upper portion of the vertical section portion 52*a*, and a condensate water dispersion portion 60 and a condensate water guide 61 for dispersedly dropping condensate water are arranged in the chamber 52*c*.

Meantime, at the inside of the vertical section portion 52*a*, a plurality of protrusion portions 59 protruding from an inner wall surface with a certain width W and spirally arranged with a certain gap along a circumferential direction. The end of each protrusion portion 59 is formed to have a predetermined tilted angle Θ upwardly along the protruding direction in order to guide condensate water dropped from the upper side to the inner wall of the vertical section portion 52*a*.

Under this construction, when a drying process is started, condensate water supplied from the condensate water supplying duct 43 is dispersed by the condensate water dispersion portion 60 thus to be dropped to the inside of the condensing duct 51. A part of the dropped condensate water is dropped to the upper surface of the protrusion portions 59 thus to flow along the upper surface of the protrusion portions 59 and the inner wall of the condensing duct 51 and is dropped, which is repeated.

Meantime, air sucked from the tub 21 by a driving of the blower fan 47 passes through the connection bellows 45 thus to upwardly flow along the condensing duct 51, and the upwardly flowing air is in contact with condensate water dropped from the condensate water guide 61 and the protrusion portions 59 thus to be fast heat-exchanged and thereby to be condensed. Dry air of which moisture is removed passes through the chamber 52*c* and the blower fan 48 thus to flow, and is heated by the heater 49. The heated air is introduced into the tub 21 thus to contain moisture of the laundry, and again sucked to outside of the tub 21, which is repeated and thereby the drying process is performed.

As aforementioned, in the present invention, there are provided the condensing duct of which one end is connected to the tub, the condensate water supplying duct connected to the condensing duct for supplying condensate water into the condensing duct, and the condensate water dispersing portion having a plurality of dispersion holes dispersedly arranged along a circumferential direction of the condensing duct for dispersing condensate water supplied from the condensing water supplying duct to the inside of the condensing duct. According to this, condensing efficiency is enhanced thus to increase drying performance.

The present invention is not limited to the aforementioned drum type washing and drying machine, but can be applied to conventionally various washing and drying machines.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A condensing apparatus of a washing and drying machine comprising: a casing that forms an accommodating space therein; a tub installed in the casing; an air duct having one end connected to the tub to thus introduce air into the tub; a blower fan that blows air along the air duct; and a heater that heats air of the air duct before being introduced into the tub, wherein the condensing apparatus further comprises:

a condensing duct having one end connected to a lower region of the tub and another end extending upwardly;

a condensate water supplying duct connected to an upper region of the condensing duct to supply condensate water into the condensing duct;

a condensate water dispersing portion provided with a plurality of dispersion holes formed along a circumferential direction of the condensing duct at spaced intervals and arranged at an outlet side of the condensate water supplying duct along a flow direction of the condensate water, to dispersedly drop condensate water supplied from the condensing water supplying duct; and a chamber having an expanded flow section area that is greater than that of the condensing duct, having a lower end connected to the condensing duct and an upper end connected to an inlet of the blower fan, and provided with a condensate water supplying opening to which the condensate water supplying duct is coupled at one side thereof, wherein the lower end of the chamber is below an upper end of the condensate water dispersing portion.

2. The apparatus of claim 1, wherein the condensing water dispersing portion is a condensate water dispersion member composed of an inner rib of a ring shape for forming an air hole through which air passes at a center thereof an outer rib arranged concentrically with the inner rib and having a larger diameter than a diameter of the inner rib; a connection bottom portion provided with a plurality of dispersion holes penetratingly formed in order to disperse and drop flowing condensate water, for connecting bottoms of the inner rib and the outer rib in order to form a condensate water channel through which the condensate water flows between the outer rib and the inner rib.

3. The apparatus of claim 2, wherein the condensing water dispersing member is composed of at least one inner dispersion portion having an air passing interval between the inner rib and connected to the condensate water channel thus for dispersing and dropping condensate water at a center region thereof, and a plurality of connection channel portion for connecting the condensate water channel and the inner dispersion portion.

4. The apparatus of claim 3, wherein at least one penetration hole for dropping condensate water is formed at a connection bottom of the connection channel portion.

5. The apparatus of claim 3, wherein the condensate water supplying duct is connected to the condensate water dispersing member along a tangential direction of the outer rib, and the connection channel portion is formed to approach to the inner dispersion portion along a circumferential direction of the inner rib.

6. The apparatus of claim 1, wherein the condensing duct has a sectional surface of a circular shape and extends downwardly from a portion where the condensing duct and the chamber are connected to each other with a predetermined length.

7. The apparatus of claim 6, further comprising a connection bellows having one end connected to a lower end of the condensing duct and another end is connected to a lower region of the tub.

8. The apparatus of claim 7, wherein a connection drain duct connected to a drain duct of the tub to drain the condensate water is formed at the connection bellows.

9. The apparatus of claim 1, wherein the condensate water dispersing portion is a condensate water guide formed as a ring shape having a predetermined diameter in order to pass air at a center thereof and provided with a cylindrical portion that guides condensate water to flow along a circumferential surface of the condensing duct and a bottom of the cylindrical portion is in contact with inside of the chamber.

10. The apparatus of claim 9, wherein a guiding inclination portion slantingly extending outwardly along a radius direction from an upper end of the cylindrical portion and extending along a circumferential direction to guide condensate water supplied from the condensate water supplying duct to overflow to a center region where the air passes is formed at an upper portion of the condensate water guide.

11. The apparatus of claim 1, wherein the condensing duct is provided with a plurality of protrusion portions protruding inwardly from an inner wall thereof.

12. The apparatus of claim 11, wherein the protrusion portions extend along a circumferential direction thereof.

13. The apparatus of claim 11, wherein the protrusion portions are spirally formed along an inner circumference of the condensing duct.

14. The apparatus of claim 13, wherein the protrusion portions are inclined towards an upper side of the condensing duct.

* * * * *